US005823261A

United States Patent [19]

Drumheller

[11] Patent Number: 5,823,261

[45] Date of Patent: Oct. 20, 1998

[54] WELL-PUMP ALIGNMENT SYSTEM

[75] Inventor: Douglas S. Drumheller, Cedar Crest, N. Mex.

[73] Assignee: Sandia Corporation, Allbuquerque, N. Mex.

[21] Appl. No.: 717,588

[22] Filed: Sep. 25, 1996

[51] Int. Cl.[6] ..... E21B 47/00; E21B 43/00; H04H 9/00; G01V 3/00

[52] U.S. Cl. ..... 166/250.01; 166/68.5; 166/105; 417/359; 415/131; 415/132; 415/901; 340/853.3; 340/854.4; 340/856.4; 367/82

[58] Field of Search ..... 166/68, 68.5, 105, 166/250.01, 255.1, 255.2, 255.3; 417/359; 415/131, 132, 901, 34; 340/853.3, 854.4, 856.3, 856.4; 367/81, 82, 911, 912

[56] References Cited

U.S. PATENT DOCUMENTS

| | | | |
|---|---|---|---|
| 3,386,385 | 6/1968 | Bartheld et al. | 415/131 |
| 3,876,016 | 4/1975 | Stinson | 175/45 |
| 4,293,936 | 10/1981 | Cox et al. | 367/82 |
| 4,314,365 | 2/1982 | Petersen et al. | 367/82 |
| 4,562,559 | 12/1985 | Sharp et al. | 367/82 |
| 4,562,560 | 12/1985 | Kamp | 367/83 |
| 5,050,132 | 9/1991 | Duckworth | 367/82 |
| 5,128,901 | 7/1992 | Drumheller | 367/82 |
| 5,148,408 | 9/1992 | Matthews | 367/82 |
| 5,289,354 | 2/1994 | Clayer et al. | 367/82 |
| 5,319,610 | 6/1994 | Airhart | 367/82 |
| 5,477,505 | 12/1995 | Drunheller | 367/82 |

OTHER PUBLICATIONS

Douglas S. Drumheller, Acoustical Prperties of Drillstrings, Geotherman Research Division, Sandia National Laboratories, undated.

*Primary Examiner*—Tamara L. Graysay
*Assistant Examiner*—Gary S. Hartmann
*Attorney, Agent, or Firm*—Gregory A. Cone

[57] ABSTRACT

An improved well-pump for geothermal wells, an alignment system for a well-pump, and to a method for aligning a rotor and stator within a well-pump, wherein the well-pump has a whistle assembly formed at a bottom portion thereof, such that variations in the frequency of the whistle, indicating misalignment, may be monitored during pumping.

18 Claims, 6 Drawing Sheets

WELL-PUMP ALIGNMENT SYSTEM

This invention was made with Government support under Contract DE-AC04-94AL85000 awarded by the U.S. Department of Energy. The Government has certain rights in the invention.

BACKGROUND OF THE INVENTION

The present invention is directed to an improved well-pump, particularly for geothermal wells, an alignment system for a well-pump, and to a system for aligning a rotor and stator within a well-pump.

A significant portion of geothermal energy in the United States is produced from binary fields. Wells in these types of fields do not flow steam naturally, but must be pumped, since the geothermal source is so far below the surface that steam generated at the source condenses before reaching the surface. Therefore, production of geothermal energy entails extracting a primary heated fluid, such as ground water, from the underground geothermal source and pumping it to the surface, and transferring heat from the primary fluid to a secondary fluid through a heat exchanger, so as to form steam to drive a turbine.

However, the vigorous conditions existing within the geothermal wells, such as high temperatures and corrosive fluids, prohibit the use of electrical motors and pumps within the wells themselves.

Accordingly, remote pumps consisting of a rotor and a stator positioned within a length of production tubing are lowered into the well casings, the rotors being driven by a drive shaft connected to a motor at the top of the well.

During production of geothermal energy from a geothermal well, the well-pump components are heated by the hot production fluid which is being pumped within the well. Differential heating of the portions of the well-pump cause differential expansion of the components, thus varying alignment between, for instance, the rotor and the stator of the well-pump and thereby causing inefficient pumping and even damage to the well-pump, due to contact between the rotor and stator during misalignment.

Due to the rigorous conditions within geothermal wells, well-pumps must be constructed of durable materials, capable of withstanding the heat and corrosive environment to which they are subjected. Even the bushings and bearings have short operating lives. The cost of these pumps is a significant portion of the cost of geothermal energy. Currently, many pumps are much larger and more expensive than necessary, due to the alignment problems between the rotors and stators of the pumps, caused by differential expansion of the components thereof.

A conventional geothermal well-pump is illustrated in FIG. 1, wherein a string of production tubing 4 is lowered into a well casing 5. At the end of the production tubing is the stator 3 and rotor 2 assembly of the pump. The stator is rigidly attached to the interior surface of the production tubing, while the rotor is attached to a drive shaft 1, which is free to move axially up and down within the production tubing. Disadvantageously, the rotor can hit the stator if not properly aligned therein.

During operation of the pump, the rotor is initially aligned with respect to the stator by raising and lowering the motor 9 and drive shaft assembly with a hoist, while monitoring the load supported by the hoist. After proper alignment, the motor is fixed into position on the well head and started. Hot production fluid rises within the production tubing due to the operation of the pump. Both the drive shaft and the production tubing are heated by this fluid, but not to equal temperatures. Thus the drive shaft expands more than the production tubing and the differential expansion acting over the entire length of the well, for example 1800 feet, alters the alignment between the stator and rotor by as much as several inches. Interference and damage to the pump is possible. During operation, measurement and adjustment of the alignment between the rotor and stator is not possible. Therefore, the stator must be oversized to allow for the differential expansion, which increases the size and cost of the pump, and additionally reduces efficiency of the pump.

Accordingly, it would be advantageous to have an alignment system for the rotor and stator which operates during rotation of the pump, so as to avoid damage to the pump, increase efficiency and reduce the overall cost. A key to this process is to continuously measure the alignment and transmit the information to the surface.

SUMMARY OF THE INVENTION

An object of the present invention is to provide means to monitor the relative positions of a rotor and stator of a well-pump, which may vary due to differential heating of the various components of the well-pump.

Another object of the present invention is to increase the efficiency and longevity of a well-pump, while reducing its cost.

A further object of the present invention is to reduce the size of a well-pump, while maintaining its efficiency.

One embodiment of the present invention is a well-pump alignment system, comprising a length of production tubing, a well-pump comprising a rotor and a stator disposed within a lower portion of said production tubing and means for monitoring alignment between said rotor and said stator, comprising a frequency generator disposed adjacent said well-pump and generating a frequency which varies dependent on the axial alignment between said rotor and stator.

Another embodiment of the present invention is directed to a well-pump alignment system, comprising a length of production tubing, a well-pump having a rotor and a stator disposed within a lower portion of the production tubing, and a frequency generator, such as a whistle assembly, disposed within the production tubing adjacent the well-pump.

Another embodiment of the present invention is directed to a self-aligning well-pump, comprising a rotor and a stator positioned within a lower portion of a length of production tubing, an apparatus for monitoring alignment between the rotor and stator, which includes a frequency generator, such as a whistle assembly, disposed within the production tubing and positioned adjacent the rotor and stator, and a device for adjusting the position of the rotor within the stator, based upon the frequency of a vibration produced by the frequency generator.

BRIEF DESCRIPTION OF THE DRAWINGS

The above and other objects, features and advantages of the present invention will be better understood from the following detailed descriptions taken in conjunction with the accompanying drawings, all of which are give by way of illustration only, and are not limitative of the present invention.

DETAILED DESCRIPTION OF THE INVENTION

The following detailed description of the invention is provided to aid those skilled in the art in practicing the present invention. Even so, the following detailed description of the invention should not be construed to unduly limit the present invention, as modifications and variations in the embodiments herein discussed may be made by those of ordinary skill in the art without departing from the spirit or scope of the present inventive discovery.

Figure 1:
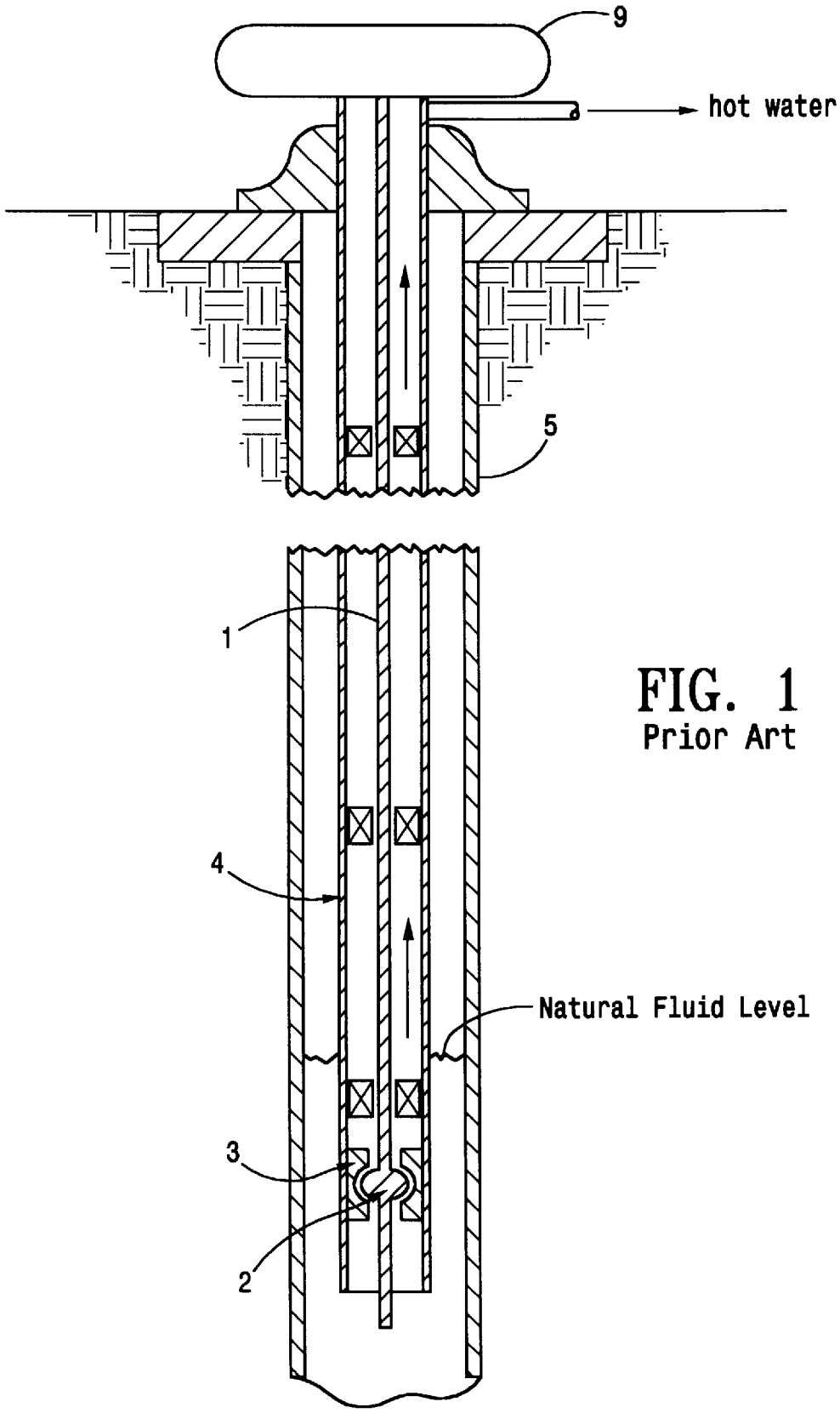
FIG. 1 Prior Art
FIG. 1 is a cutaway illustration of a conventional well-pump.
Figure 2:
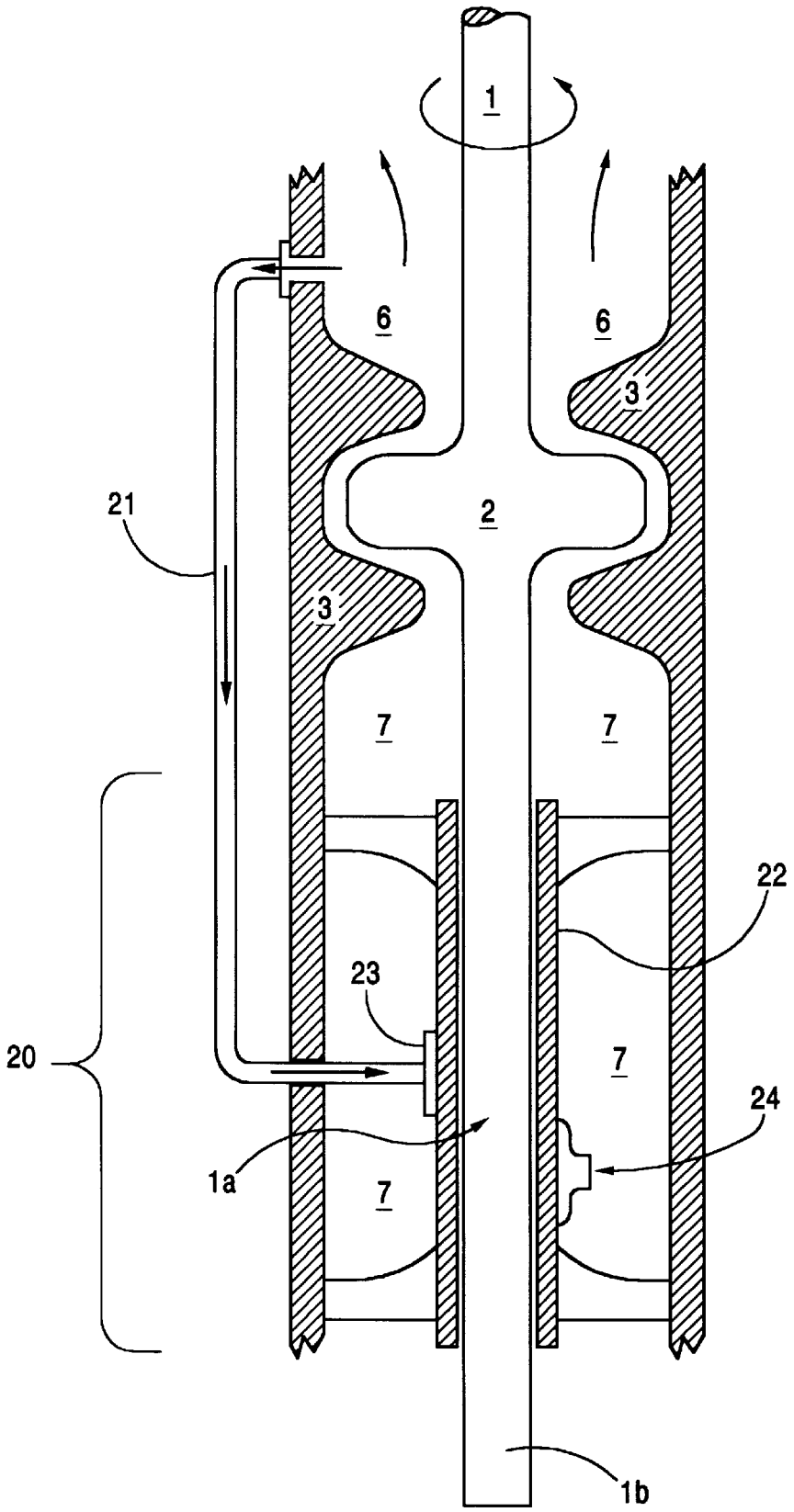
FIG. 2 is a cutaway view of a lower portion of a well-pump and whistle assembly according to the present invention.

In one embodiment of the present invention, FIG. 2, a frequency generator is a whistle assembly 20 formed at the bottom of the pump (2 and 3), incorporating a portion of the drive shaft 1*a* into the whistle assembly. A hollow feed tube 21 is connected between the high-pressure side of the pump 6 and the outer collar of the whistle assembly 22 at intake section 23, so as to force high pressure production fluid through the whistle assembly. The high pressure fluid eventually exhausts into the low-pressure reservoir 7, through exhaust section 24, creating axial vibrations in the drive shaft. Upon rotation of the pump, the whistle assembly generates a low-amplitude, high-frequency vibration in the drive shaft at the pump, which is transmitted through the metal drive shaft, along the length of the drive shaft to the top of the system.

It has been determined that sound waves will readily travel through the drive shaft of a conventional well-pump, throughout the entire length of the system, from pump to motor. Vibrations axial to the drive shaft are most readily transmitted and monitored, but production and monitoring of torsional vibration is also within the scope of the present invention. The vibrations may be of an audible frequency, or an inaudible frequency.

Figure 3:
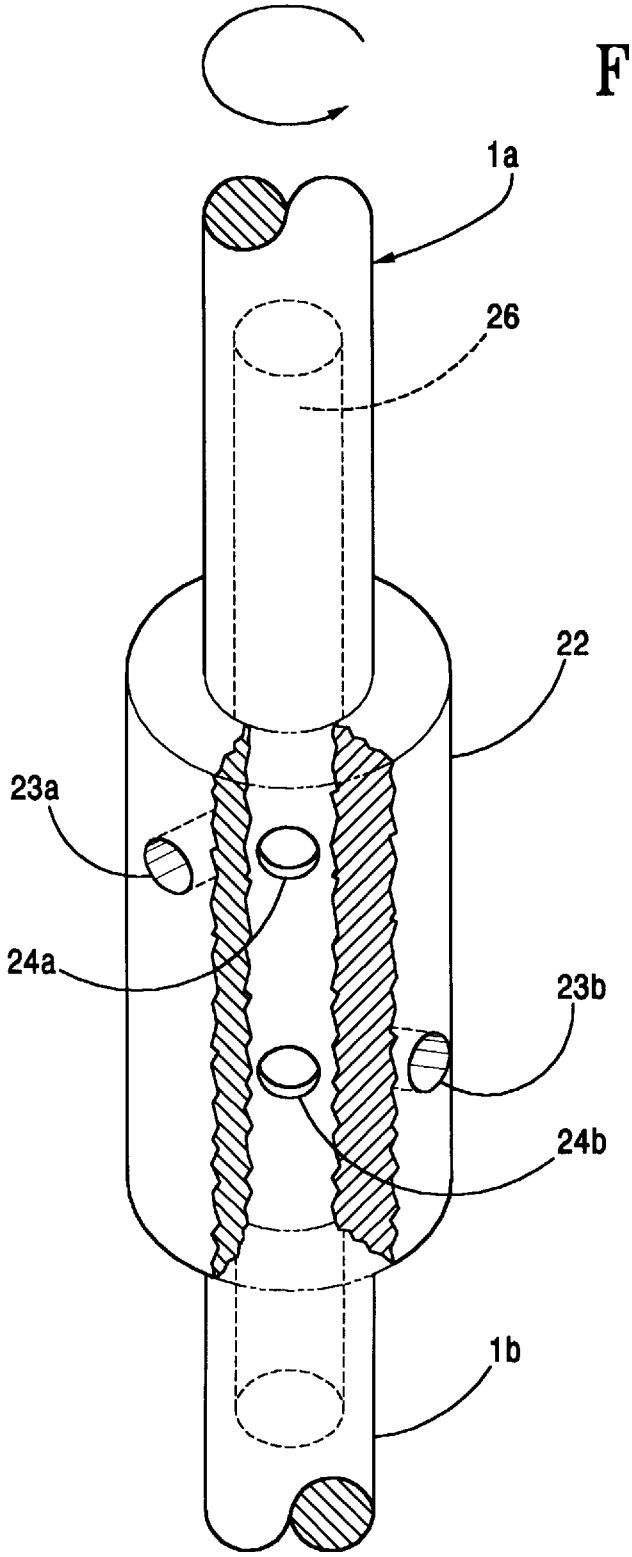
FIG. 3 is an illustration of a first embodiment of the whistle of the present invention.

The whistle assembly, FIG. 3, comprises an annular fixed collar 22 having an intake port 23*a* through its circumference and attached to the interior wall of the production tubing. A hollow resonance chamber 26 portion of the drive shaft 1*a* having an intake port 24*a* and an exhaust port 24*b* through its circumference is positioned within the fixed collar, and a hollow feed tube is connected between a high pressure side of the well-pump and the fixed collar (see FIG. 2). The intake port 23*a* on the fixed collar is connected to the high pressure fluid input from the hollow feed tube 21. When the intake port 24*a* on the drive shaft aligns with the intake port 23*a* on the collar, the high pressure fluid will enter the chamber 26. As the drive shaft continues to rotate, the intake ports 23*a* and 24*a* will go out of alignment, trapping most of the pressure inside the chamber. With continued rotation, the exhaust port 24*b* of the chamber will align with the exhaust port 23*b* of the collar, releasing the pressure out of the chamber 26 via fitting 24 shown in FIG. 2. Thus as the drive shaft makes one revolution, the resonant chamber is pressurized by the input flow and then exhausted to the reservoir, producing a pulse. Typically, the motor rotates the drive shaft at 1800 rpm, and thus the whistle produces a 1800 (rpm)/60 (sec/min)=30 Hz tone in the drive shaft. In this simple case, the tone will either be on or off since there is only one pair of intake ports and one pair of outlet ports.

Figure 4:
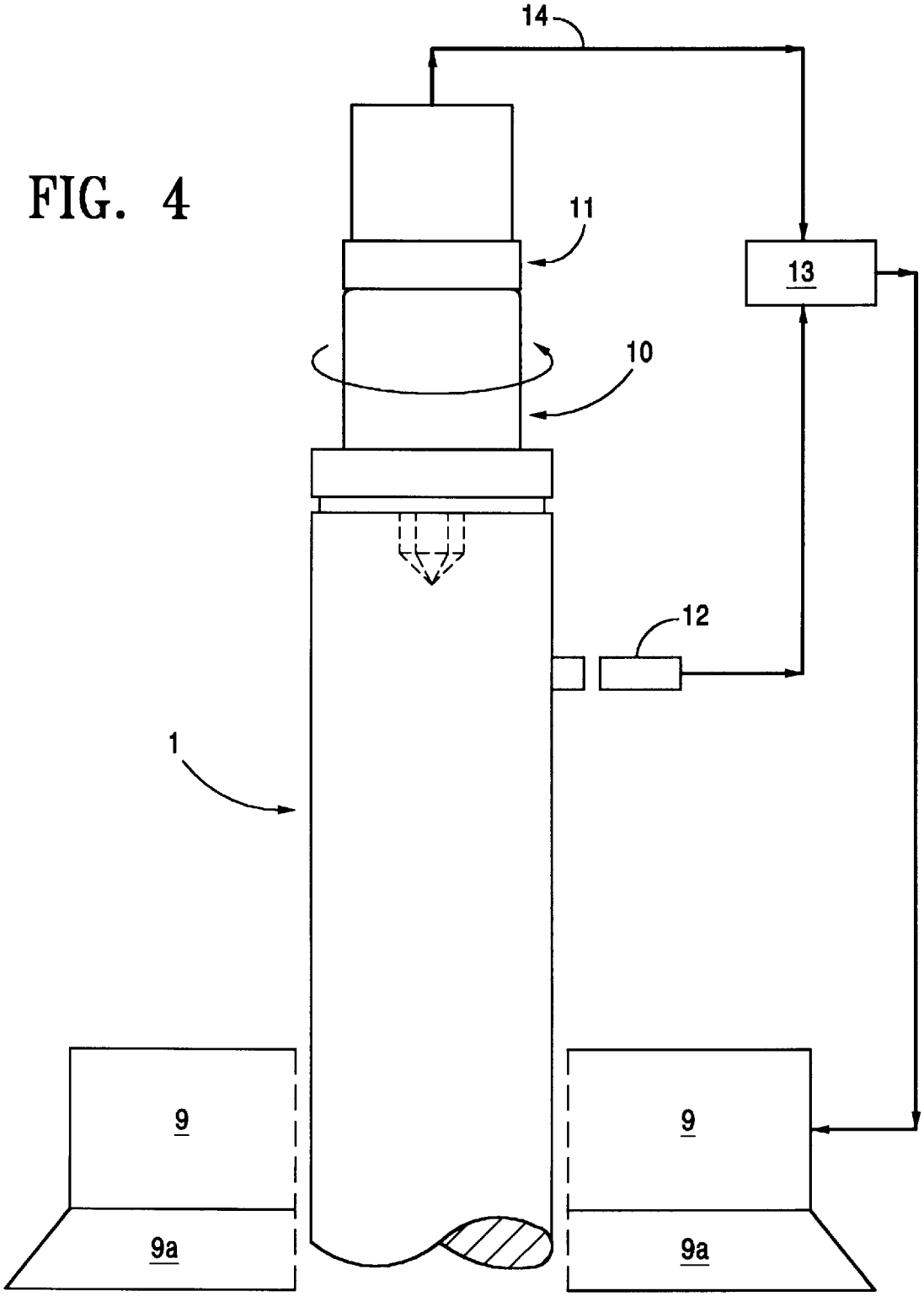
FIG. 4 is a diagram of a top portion of a well-pump and well-pump alignment system according to the present invention.

It is also desirable to include a lower extension of shaft 1*b* below the whistle. A typical length is about 7 feet. This length is selected to be close to ¼ of the wavelength of the tone that is being produced. For example, if the shaft is rotating at 1800 rpm (30 Hz) and there are 15 intake ports and 15 exhaust ports, the a 450 Hz tone will be produced. The speed of sound in a steel shaft is 16,800 ft/sec. The wavelength of this tone is: 16800/450=37 ft. A lower shaft extension of 37/4=9.3 ft would be optimal for this wavelength. However, since multiple tones are normally produced, the length of the shaft extension should be a compromise The vibrations are continuously produced and transmitted through the drive shaft 1 to the top of the well-pump assembly by extensional wave propagation, FIG. 4, where the vibrations reflect off the drive shaft and are measured by a suitable sensor 10, such as an accelerometer. Piezoelectric accelerometers having a 10 G or 50 G peak capability are preferred. The sensor rotates with the drive shaft, and a slip ring 11 is used to connect the sensor to a fixed data and power cable 14. Concurrently, the rotation rate of the shaft is measured with any conventional electronic tachometer 12, and both sets of data are fed into a simple microprocessor 13, which divides the numerical value of the frequency measured by the number of revolutions per second, to obtain the number of ports which are aligned at any axial position of the rotor/stator combination. The output of the microprocessor provides the desired alignment data necessary to adjust the position of the motor 9, and thus the alignment of the rotor with the stator. The motor is mounted on a movable base 9*a* which continuously adjusts the height of the motor 9 to keep the pump in alignment during operation of the system.

Figure 5:
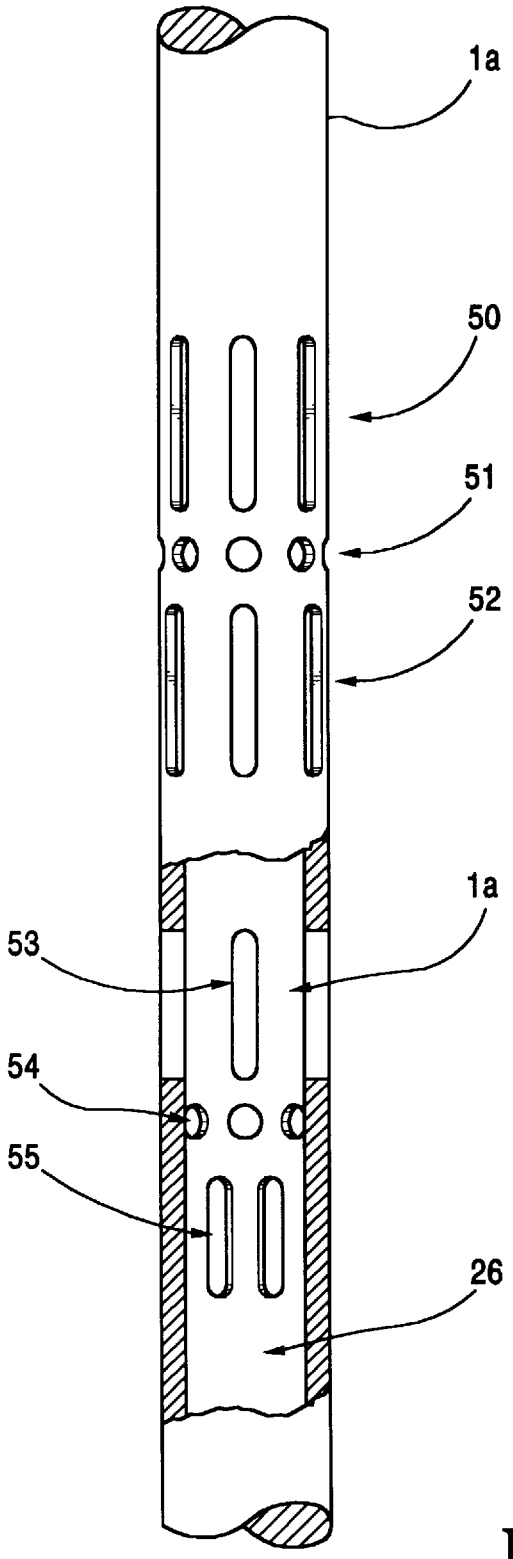
FIG. 5 is an alternative embodiment of a more complex whistle of the present invention.
Figure 6:
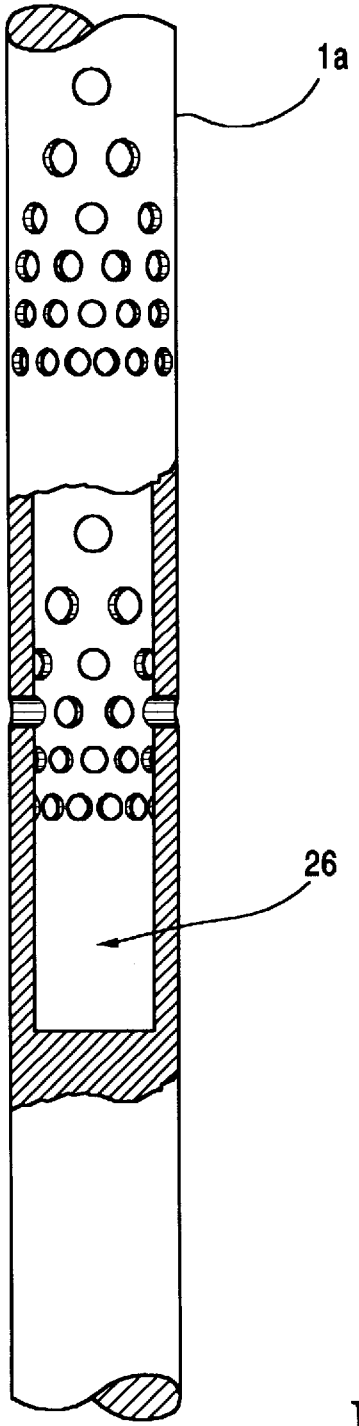
FIG. 6 is another embodiment of a more complex whistle of the present invention.

FIGS. 5 and 6 illustrate alternative embodiments of the whistle assembly of the present invention, wherein the number and shape of the ports are varied, so as to customize the whistle pattern relative to the information required.

For example, FIG. 5 illustrates a "high-low" whistle. The drive shaft 1*a* here has three sets of input ports, upper 50, middle 51 and lower 52, and three sets of exhaust ports, upper 53, middle 54 and lower 55. The collar is not shown in this view but is similar to that shown in FIG. 3 having one input port and one exhaust port. The spacing of these collar ports in the longitudinal direction is the same as the spacing between the middle ports 51 and 54 in the collar. There are here nine of the input upper ports, and nine of the exhaust upper ports; ten of the input middle ports, and ten of the exhaust upper ports; and eleven of the input lower ports, and eleven of the exhaust lower ports. Due to the port pattern, it produces 9 pulses per shaft rotation if the alignment is too low, and 11 pulses per rotation if the alignment is too high. When alignment is correct, 10 pulses per rotation are produced. If the pump is in proper alignment, a 500 Hz tone might be produced, while if the rotor is too high a 550 Hz tone would be produced, and if the rotor is too low a 450 Hz tone would be produced. The shape of the upper and lower ports is elongated to give an operator more tolerance in the measurement of misalignments. However, they could also be made to be the same size and shape as the middle ports if more precision were required.

FIG. 6 illustrates a "position" whistle having a continuously increasing number of ports from top to bottom, so as to provide a continuous modulation of frequencies, dependent on the position of the whistle, corresponding to the number of ports. Accordingly, for a given frequency of the whistle, the precise location of the whistle and therefore the rotor may be determined. As with FIG. 5, the collar assembly is not shown but has a single input port and a single exhaust port as in FIG. 3. In both FIG. 5 and FIG. 6, it would be theoretically possible to utilize a collar having two (or more) input ports and a corresponding number of exhaust ports; however, the single input and single exhaust port configuration is much less complicated and preferred.

The invention being thus described, it will be apparent that the same may be varied in many ways. Such variations are not to be regarded as a departure from the spirit and scope of the invention, and all such modifications as would be apparent to one skilled in the art are intended to be included within the scope of the following claims.

I claim:

1. A well-pump alignment system, comprising:

a length of production tubing;

a well-pump comprising a rotor and a stator disposed within a lower portion of said production tubing; and means for monitoring alignment between said rotor and said stator, comprising a frequency generator disposed adjacent said well-pump and generating a frequency which is a function of the alignment along the longitudinal axis of the tubing between said rotor and stator.

2. The well-pump alignment system according to claim 1, wherein said frequency generator is disposed within said production tubing below said well-pump.

3. The well-pump alignment system according to claim 2, wherein said frequency generator is a whistle assembly comprising:

an annular fixed collar having one input port and one exhaust port separated by a first distance longitudinally and a second distance radially through its circumference, attached to the interior wall of said production tubing;

a hollow portion of a drive shaft for said rotor having at least one input port and at least one exhaust port through its circumference, positioned within said fixed collar; and a hollow feed tube connected between a high pressure side of said well-pump and said fixed collar for supply of high pressure fluid to said whistle assembly for communication of the high pressure fluid into the hollow portion when the input port on the collar and one of the input ports of the drive shaft are aligned, with the high pressure fluid later leaving the hollow portion when one of the exhaust ports of the drive shaft and the exhaust port of the collar are later aligned.

4. The well-pump alignment system according to claim 3, wherein said hollow portion of said drive shaft has multiple input ports and multiple exhaust ports.

5. The system of claim 4 wherein the multiple input ports and multiple exhaust ports are configured as bands disposed circumferentially about the drive shaft with there being at least three bands of input ports, each with a different number of ports, and the same number of bands of exhaust ports, each with the same respective number of ports as the corresponding band of input ports, with the bands of input and exhaust ports having the same number of ports being separated by the first distance.

6. The well-pump alignment system according to claim 3, wherein the ports in said fixed collar and the ports in said drive shaft are positioned relative to each other so as to produce vibrations due to passage of high pressure fluid through said whistle assembly, upon rotational operation of said well-pump.

7. The well-pump alignment system according to claim 2, wherein said monitoring means further comprises a sensor for detecting the vibrations of said frequency generator.

8. The well-pump alignment system according to claim 7, wherein said monitoring means further comprises a tachometer for measuring the rotational speed of the well-pump.

9. The well-pump alignment system according to claim 8, wherein said monitoring means further comprises a microprocessor to relate the output of the sensor to the output of the tachometer, to determine the number of ports producing the vibrations and therefore the axial position of the rotor relative to the stator.

10. The well-pump alignment system according to claim 9, further comprising means for adjusting the position of the rotor within the stator according to the output of said monitoring means, connected to said monitoring means.

11. A method of aligning a rotor within a stator of a well-pump, comprising:

providing a frequency generator adjacent said well-pump;

rotating said rotor, so as to produce a vibrational output from said frequency generator of a first frequency;

monitoring variations in the output produced by the frequency generator, due to variations in axial alignment between said rotor and stator; and adjusting the relative position of said rotor within said stator so as to obtain said first frequency.

12. A self-aligning well-pump, comprising:

a rotor and a stator positioned within a lower portion of a length of production tubing;

means for monitoring alignment between said rotor and stator; and means operatively connected to said rotor for adjusting the position of said rotor within said stator.

13. The self-aligning well-pump of claim 12, wherein said rotor is affixed to a drive shaft, and said drive shaft is operatively connected to a motor at an upper end of said length of production tubing.

14. The self-aligning well-pump of claim 13, wherein said monitoring means comprises a frequency generator disposed within said production tubing and adjacent said rotor and stator.

15. The self-aligning well-pump of claim 14, wherein said monitoring means further comprises a sensor for monitoring the frequency of a vibration produced by said frequency generator upon operation of said well-pump, said frequency being a function of the alignment of the rotor within the stator.

16. The self-aligning well-pump of claim 14, wherein said frequency generator is a whistle assembly comprising:

an annular fixed collar having one input port and one exhaust port separated by a first distance longitudinally and a second distance radially through its circumference, attached to the interior wall of said production tubing;

a hollow portion of a drive shaft for said rotor having at least one input port and at least one exhaust port through its circumference, positioned within said fixed collar; and a hollow feed tube connected between a high pressure side of said well-pump and said fixed collar for supply of high pressure fluid to said whistle assembly for communication of the high pressure fluid into the hollow portion when the input port on the collar and one of the input ports of the drive shaft are aligned, with the high pressure fluid later leaving the hollow portion when one of the exhaust ports of the drive shaft and the exhaust port of the collar are later aligned.

17. The self-aligning well-pump according to claim 16, wherein the ports in said fixed collar and thes port in said drive shaft are positioned relative to each other so as to produce vibrations due to passage of high pressure fluid through said whistle assembly, upon rotational operation of said well-pump.

18. The self-aligning well-pump system according to claim 16, wherein said hollow portion of said drive shaft has multiple input ports and multiple exhaust ports.

* * * * *